US011240587B1

(12) United States Patent
DeMaio

(10) Patent No.: US 11,240,587 B1
(45) Date of Patent: Feb. 1, 2022

(54) DYNAMICALLY RESIZABLE EARBUDS

(71) Applicant: Robert Charles DeMaio, Incline Village, NV (US)

(72) Inventor: Robert Charles DeMaio, Incline Village, NV (US)

( * ) Notice: Subject to any disclaimer, the term of this patent is extended or adjusted under 35 U.S.C. 154(b) by 0 days.

(21) Appl. No.: 17/305,714

(22) Filed: Jul. 13, 2021

(51) Int. Cl.
*H04R 25/00* (2006.01)
*H04R 1/10* (2006.01)

(52) U.S. Cl.
CPC ..... *H04R 1/1041* (2013.01); *H04R 1/1016* (2013.01); *H04R 1/1066* (2013.01)

(58) Field of Classification Search
CPC ..... H04R 1/1041; H04R 1/1016
See application file for complete search history.

(56) References Cited

U.S. PATENT DOCUMENTS

2007/0116319 A1* 5/2007 Hagberg ..... H04R 1/1016 381/380
2009/0116677 A1* 5/2009 Jones ..... H04R 1/1016 381/380
2011/0103609 A1* 5/2011 Pelland ..... H04R 3/00 381/74
2012/0076341 A1* 3/2012 Ozawa ..... H04R 1/1016 381/380
2012/0155689 A1* 6/2012 Milodzikowski .... H04R 1/1016 381/379
2013/0092470 A1* 4/2013 Johnston ..... H04R 1/105 181/129
2016/0050477 A1* 2/2016 Ushakov ..... H04R 1/105 381/380
2018/0003984 A1* 1/2018 Lai ..... G02B 27/0176
2018/0332379 A1* 11/2018 McGarry ..... H04R 1/1058
2019/0116412 A1* 4/2019 Prelogar ..... H04R 1/1016
2020/0222272 A1* 7/2020 George ..... A61F 11/00

* cited by examiner

*Primary Examiner* — Simon King
(74) *Attorney, Agent, or Firm* — Tatonetti IP

(57) ABSTRACT

A pair of earbuds are configured with a rotatable knob that connects to the earbud's main body and, responsive to user adjustment, adjusts the size of the silicone ear tip on the fly. The rotatable knob connects to an end of the earbud's main body, and the silicone tip attaches to an opposite end of the rotatable knob. The ear tip, typically comprised of silicone, snugly conforms to a shape of the rotatable knob so that when an adjustment section of the rotatable knob adjusts, the adjustment reflects onto the tip. The earbud's main body is equipped with a receptacle to which connectors on the rotatable knob attach. The connector is part of the rotatable knob, which includes the adjustment section. Clockwise and counterclockwise rotation of the knob results in an adjustment to the adjustment section and the size of the knob's exterior.

14 Claims, 11 Drawing Sheets

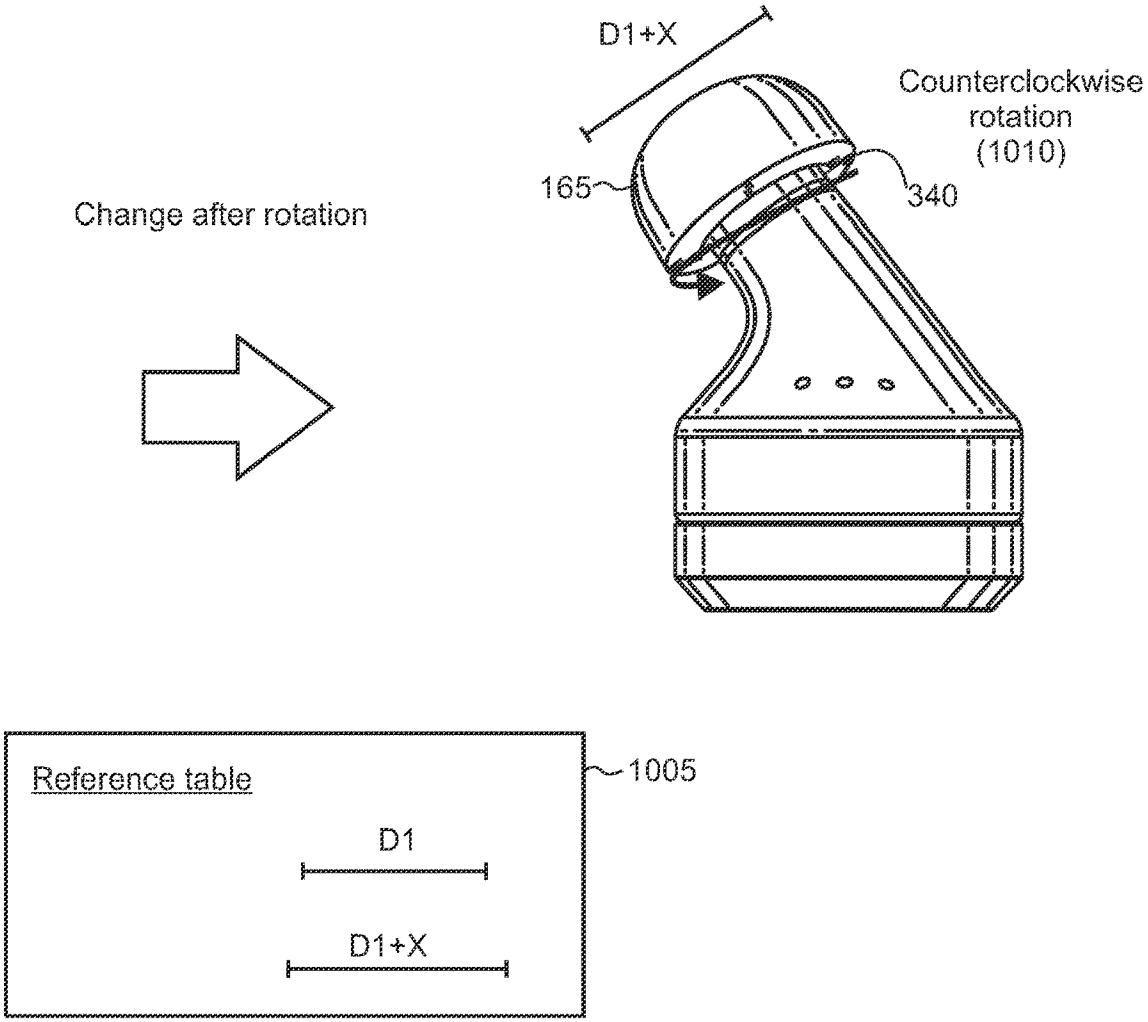
FIG 10
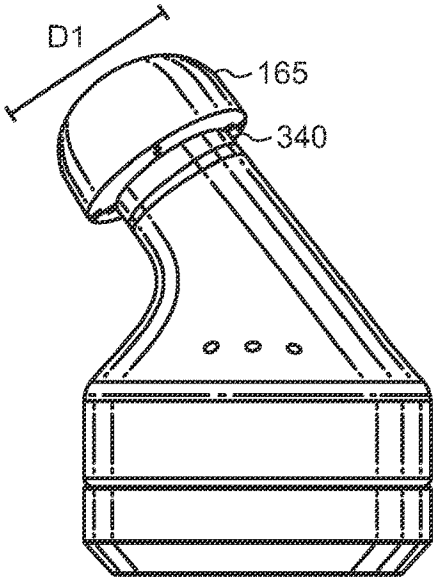

DYNAMICALLY RESIZABLE EARBUDS

BACKGROUND

Some earbuds come bundled with multiple pairs of tips—typically comprised of silicone—that fit over the earbud's speaker. Each pair of tips is of a different size to accommodate differently sized user ear canals. Replacing the tips can be an annoying extra task when purchasing a new pair of earbuds, can restrict the earbuds to a single user's ears, and can limit the user to specifically provided sized tips.

SUMMARY

A pair of earbuds are configured with a rotatable knob that connects to the earbud's main body and, responsive to user adjustment, adjusts the size of the silicone ear tip (referred to herein as "ear tip" or "tip" for short) on the fly. The rotatable knob connects to an end of the earbud's main body, and the silicone tip attaches to an opposite end of the rotatable knob. The ear tip, typically comprised of silicone, snugly conforms to a shape of the rotatable knob so that when an adjustment section of the rotatable knob adjusts, the adjustment reflects onto the tip.

The earbud's main body is equipped with a receptacle to which connectors on the rotatable knob attach. The connector and receptacle may be detachable or may be permanent attachments to prevent any inadvertent removal of the rotatable knob from the main body and external debris or liquid from entering the earbud's interior. The connector is part of the rotatable knob, which includes the adjustment section. Clockwise and counterclockwise rotation of the knob results in an adjustment to the adjustment section and the size of the knob's exterior. Specifically, at least a portion of the exterior of the rotatable knob correspondingly contracts and expands with the adjustment section.

The adjustment section includes a series of dynamic honeycomb (or hexagonal shapes) that extend around an inside diameter of the rotatable knob. The honeycombs are adjustable, conformable, and malleable to enable size adjustments to the knob. The honeycombs attach to a fixed inside wall and a rotatable outside wall. The honeycombs and outside wall may typically be comprised of rubber material, but other materials that may be used include silicone, elastic material, soft plastic, or other similarly malleable material that still provides sufficient strength.

The honeycombs and external wall may be formed of a single piece of material to provide greater strength to the structure. As the external wall rotates responsive to a user turning the rotatable knob, the honeycombs either expand or contract with the knob, depending on whether the rotation is clockwise or counterclockwise. The honeycombs, inside wall, and external wall are configured such that the honeycombs may be formed of a single or attachable structure to the walls. The honeycombs are preconfigured to enter into different positions, such as four different positions, when the knob rotates. The honeycombs are strong enough to support the external wall, which provides sufficient support to the rotatable knob and silicone ear tip when inside a user's ear.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Furthermore, the claimed subject matter is not limited to implementations that solve any or all disadvantages noted in any part of this disclosure. It will be appreciated that the above-described subject matter may be implemented as a computer-controlled apparatus, a computer process, a computing system, or as an article of manufacture such as one or more computer-readable storage media. These and various other features will be apparent from a reading of the following Detailed Description and a review of the associated drawings.

DESCRIPTION OF THE DRAWINGS

FIG. 10 shows an illustrative representation of an enlarged earbud tip after a counterclockwise rotation of the rotatable knob.

Like reference numerals indicate like elements in the drawings. Elements are not drawn to scale unless otherwise indicated.

DETAILED DESCRIPTION

Figure 1:
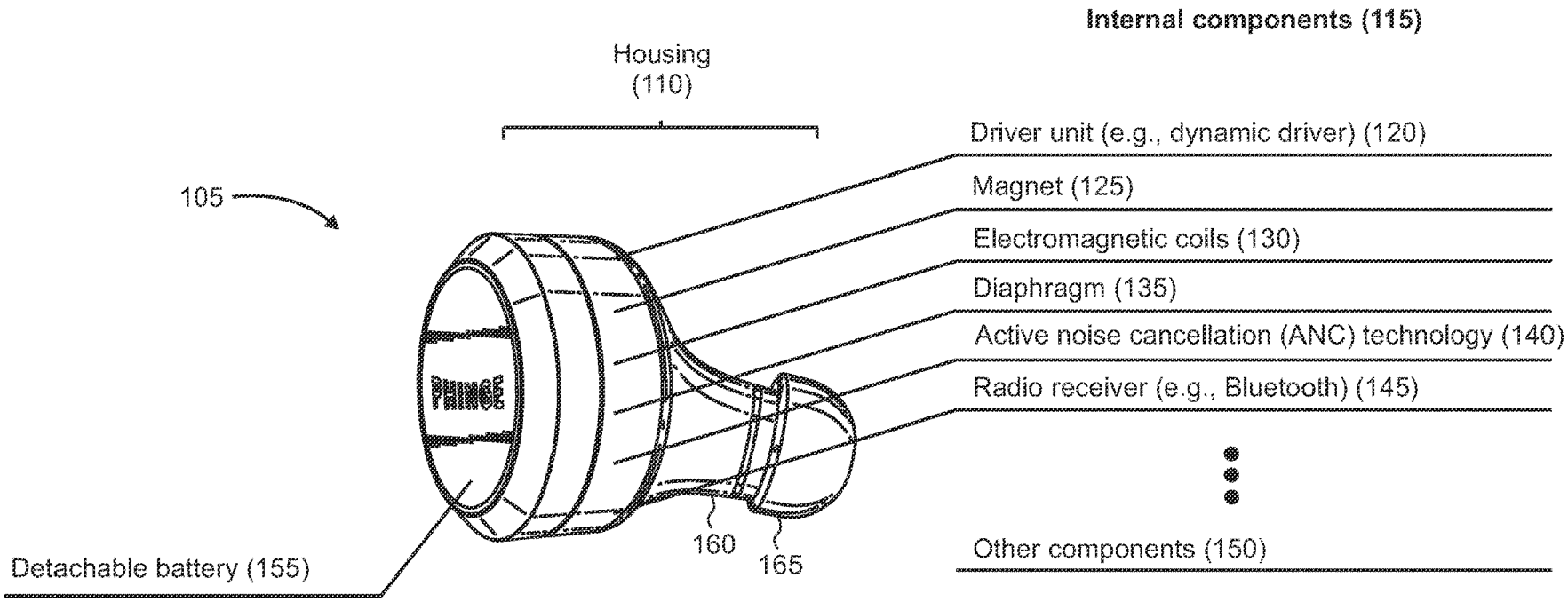
FIG. 1 shows an illustrative representation of an earbud.

FIG. 1 shows an illustrative representation of an earbud 105, which has a main body 160, a silicone ear tip 165 that is inserted into a user's ear, and a detachable battery 155. The battery may be a rechargeable lithium-ion (Li-ion) battery that can receive a charge for re-use. The battery may have a universal serial bus (USB) port (e.g., micro USB, macro USB, etc.), or a proprietary charging case may be utilized to receive a charge. Discussion of the removable battery can be viewed in U.S. application Ser. No. 17/305,474, filed Jul. 8, 2021, entitled "Interchangeable and Rechargeable Batteries for Earbuds," the entire contents of which is hereby incorporated herein by reference. The ear tip may have a deformable lip inserted over a rigid lip on the earbud to maintain its position. While a single earbud is shown in the drawings, a second earbud that fits inside a user's other ear may be configured similarly so a user can use two earbuds simultaneously, as commonly done. The earbud has a housing 110 that protects its internal components 115, which operate the earbud, namely, play sound. The housing may be comprised of plastic, metal, or some other suitable polymer.

The earbud may receive analog signals that have been converted using a digital-to-analog converter (DAC) either at the computer sending the signals or the earbud. The analog signals are processed at a driver unit 120, including a dynamic driver, planer magnetic driver, or an electrostatic driver. In addition, the driver unit may include a permanent magnet 125, electromagnetic coils 130, and a diaphragm 135 used to translate the signals into sound.

In a dynamic driver 120, electromagnetic coils 130 may switch the signal's polarity back and forth depending on its pattern (or reproducible sound), and the switched signals may engage with the permanent magnet for vibration. The signals are received by the diaphragm 135, a thin membrane, which causes the air to vibrate and which users perceive as sound. Other driver units operate differently, but such driver units may also be utilized in the present disclosure. The type of driver unit and sound-producing earbuds do not affect the present disclosure.

The earbud's internal components 115 may likewise be configured with active noise cancellation (ANC) technology 140, preventing ambient noises from distracting the user during earbud use. The earbud may include a radio receiver (e.g., Bluetooth®) 145 to wirelessly receive the digital or analog signals from a computing device, such as a smartphone, tablet computer, personal computer, laptop computer, etc. The earbud may include other components 150 not mentioned, but as would typically be understood for earbuds for operating.

Figure 2:
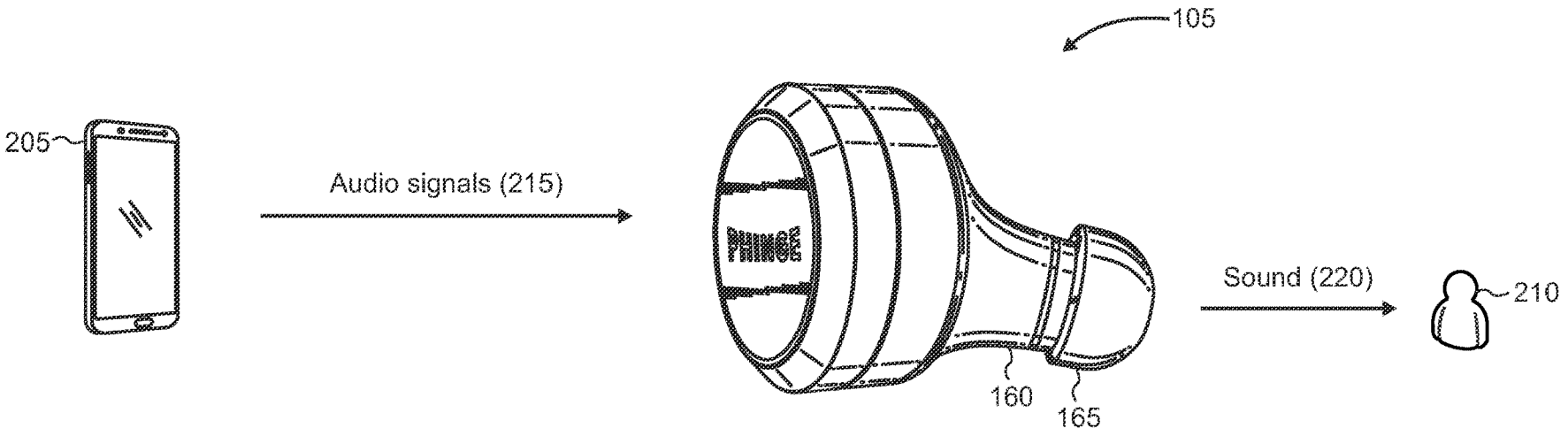
FIG. 2 shows an illustrative diagram of an earbud playing sound received from a smartphone device.

FIG. 2 shows an illustrative use implementation in which the earbud 105 receives audio signals 215 from a smartphone computing device 205. One or both of the smartphone or earbuds may be adapted with a DAC that converts the digital signals into analog signals for translation into sound by the earbud (FIG. 1). Upon receiving and processing the signals, the earbud outputs sound 220 to the user 210.

Figure 3:
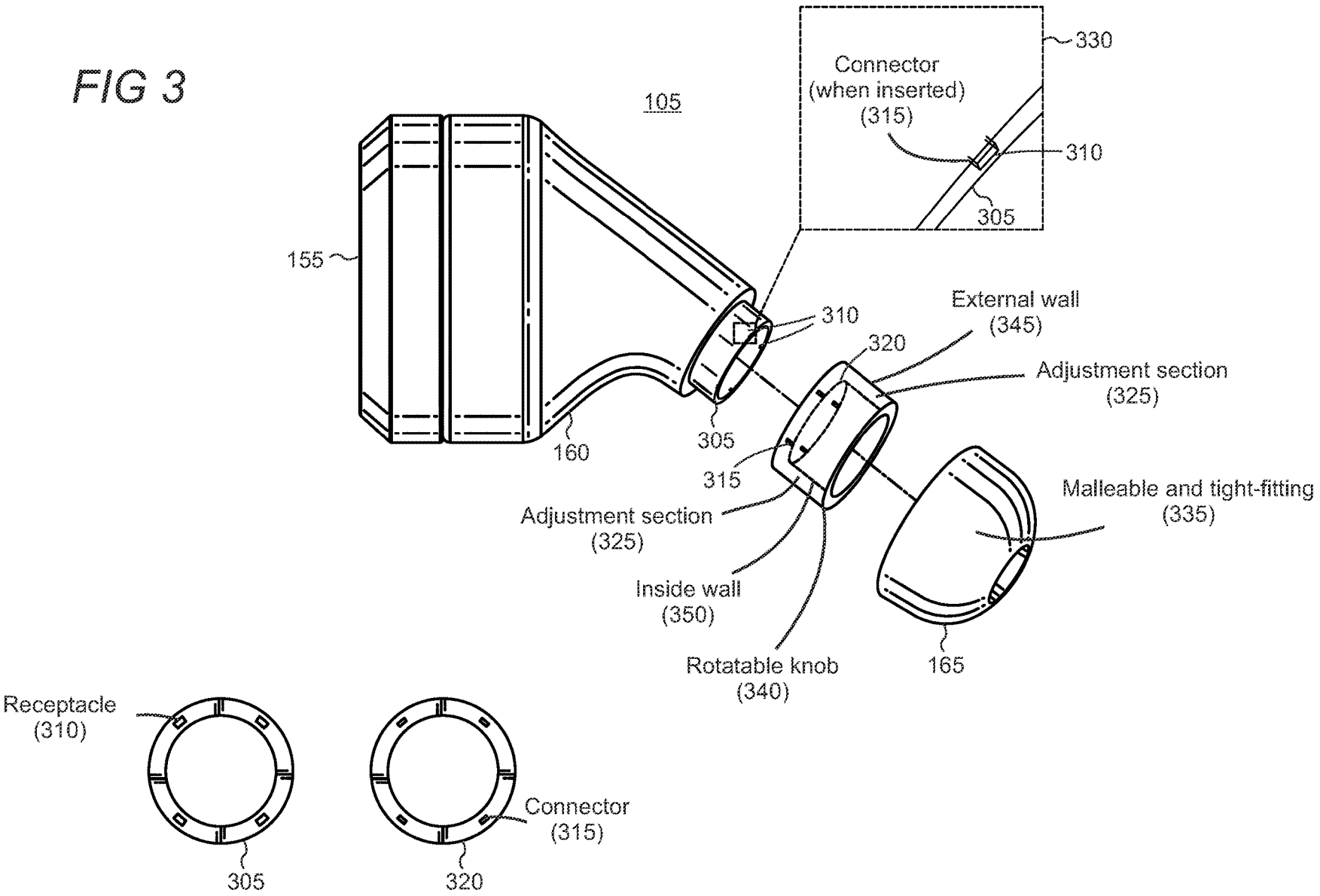
FIG. 3 shows an illustrative exploded diagram of the earbud's rotatable knob, which enables size adjustments for the earbud's tip.

FIG. 3 shows an illustrative exploded diagram in which the main body 160, rotatable knob 340, and ear tip 165 are aligned. The main body includes a female attachment 305 that includes receptacles 310. The knob includes a male connector 320 having a series of connectors 315 that respectively engage with the receptacles 310, which enables attachment of the rotatable knob to the main body. The connection may be a friction fit or tab and notch arrangement. Depending on the scenario, a screw may be used through the male connector 320 to the female attachment 305 to connect permanently. As shown in the close-up section 330, the connectors 315 extend through the receptacles 310 to secure the rotatable knob to the main body.

Although not shown, the speaker from which sound is output may be at the end of the female attachment 305 or may extend to the rotatable knob 340, depending on the implementation. For example, the speaker may be placed toward an end of the rotatable knob in scenarios in which the knob is permanently attached to the main body. Alternatively, the speaker may be placed toward an end of the main body or at or adjacent to the female attachment 305 if the rotatable knob is a temporary and user-removable attachment.

The rotatable knob 340 includes an adjustment section 325 within its interior that provides the dynamic resizing of the rotatable knob's external wall 345. The ear tip 165 is malleable and tight-fitting 335 against the rotatable knob so that changes to the knob reflect on the tip. The external wall of the rotatable knob may be comprised of a material that conforms to the adjustment section's dynamic body. The external wall may be, for example, comprised of a rubber, silicone, an elastic material, or a hybrid material thereof that contracts in a rest position but stretches and expands responsive to some outside force. While the external wall 345 is rotatable, the inside wall 350 is fixed in place.

Figure 4:
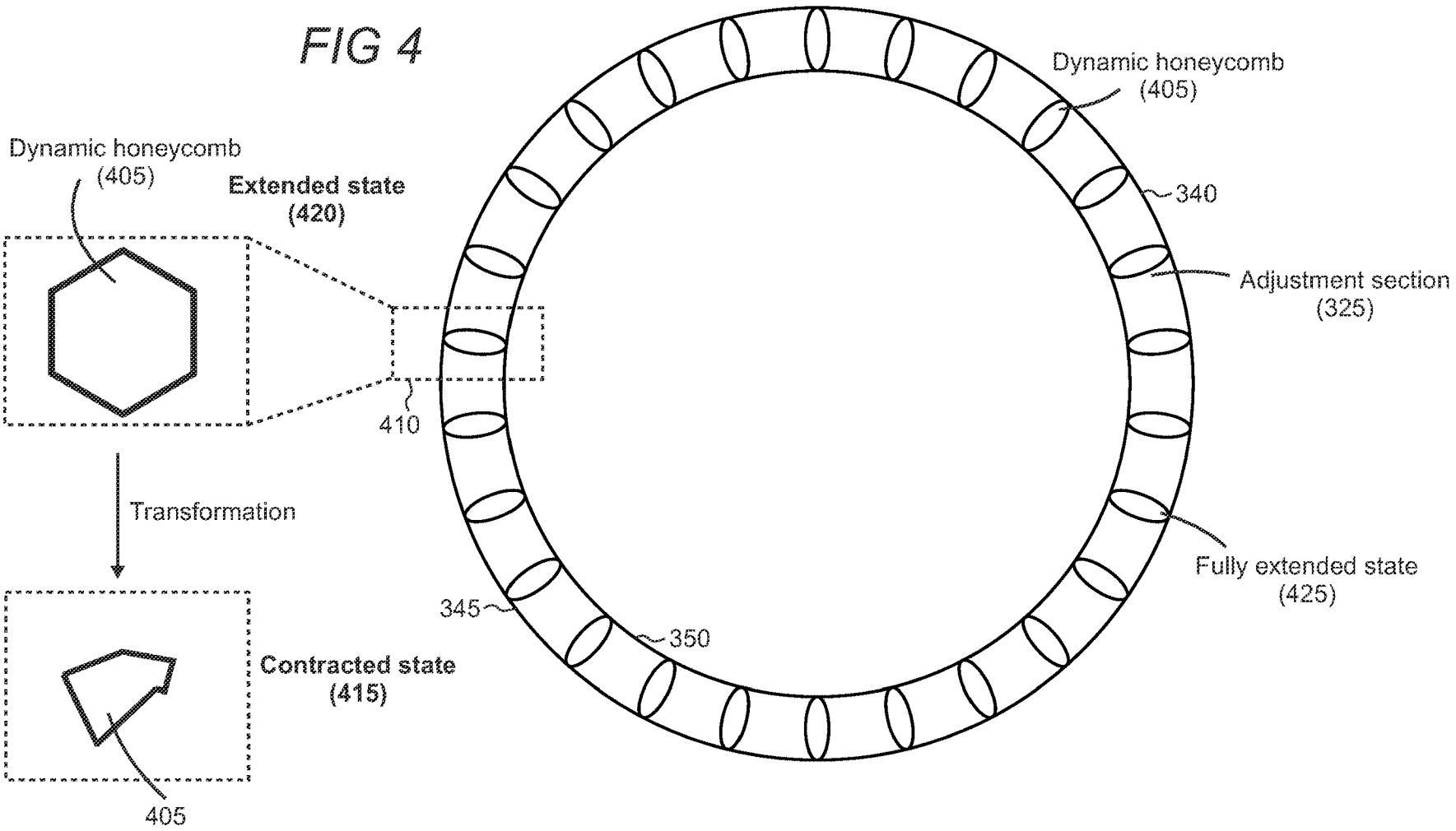
FIG. 4 shows an illustrative representation of the dynamicity of the honeycombs in use.

FIG. 4 shows an illustrative representation of dynamic honeycombs 405 (or hexagonal shapes) across an entire diameter of the inside and external walls 350, 345. Like the external wall, the honeycombs may likewise be constructed of rubber, silicone, elastic, a combination thereof, or another malleable material for the purposes herein. In the fully extended state 425, the honeycombs are in their standard position, as representatively shown by numeral 420. The honeycombs go through transformations as the external wall 345 (or rotatable knob 340) is rotated, as representatively shown by the contracted state 415. As shown, the honeycombs are malleable and can scrunch as the user rotates the knob, which thereby causes the external wall to contract. Opposite rotations cause the honeycomb to expand again.

The external wall 345 and honeycombs 405 may be formed of the same material and may be constructed of a single piece of material to maintain strength. In other embodiments, however, the honeycombs may be attached to the interior of the external wall. The honeycombs may be attached to the fixed inside wall via some permanent fastening mechanism so that the honeycombs only adjust responsive to the external wall's rotation. For example, adhesive, screws, bolts, or other fastening mechanisms may be used.

While a honeycomb design is illustrated herein, other sizes and shapes may also be utilized. In this regard, the honeycombs may be considered malleable support structures that extend around the external wall's interior diameter. The malleable support structures may be comprised of other shapes, such as square, rectangle, oval, circular, football-shaped, or other polygonal shapes. In typical implementations, the support structures may be evenly spaced about the diameter; however, the layout of the support structures may be variable and accommodate locations that may require additional support. Furthermore, the support structures may have a distance between each other or be adjacently connected to each other to provide even greater support.

Figure 5:
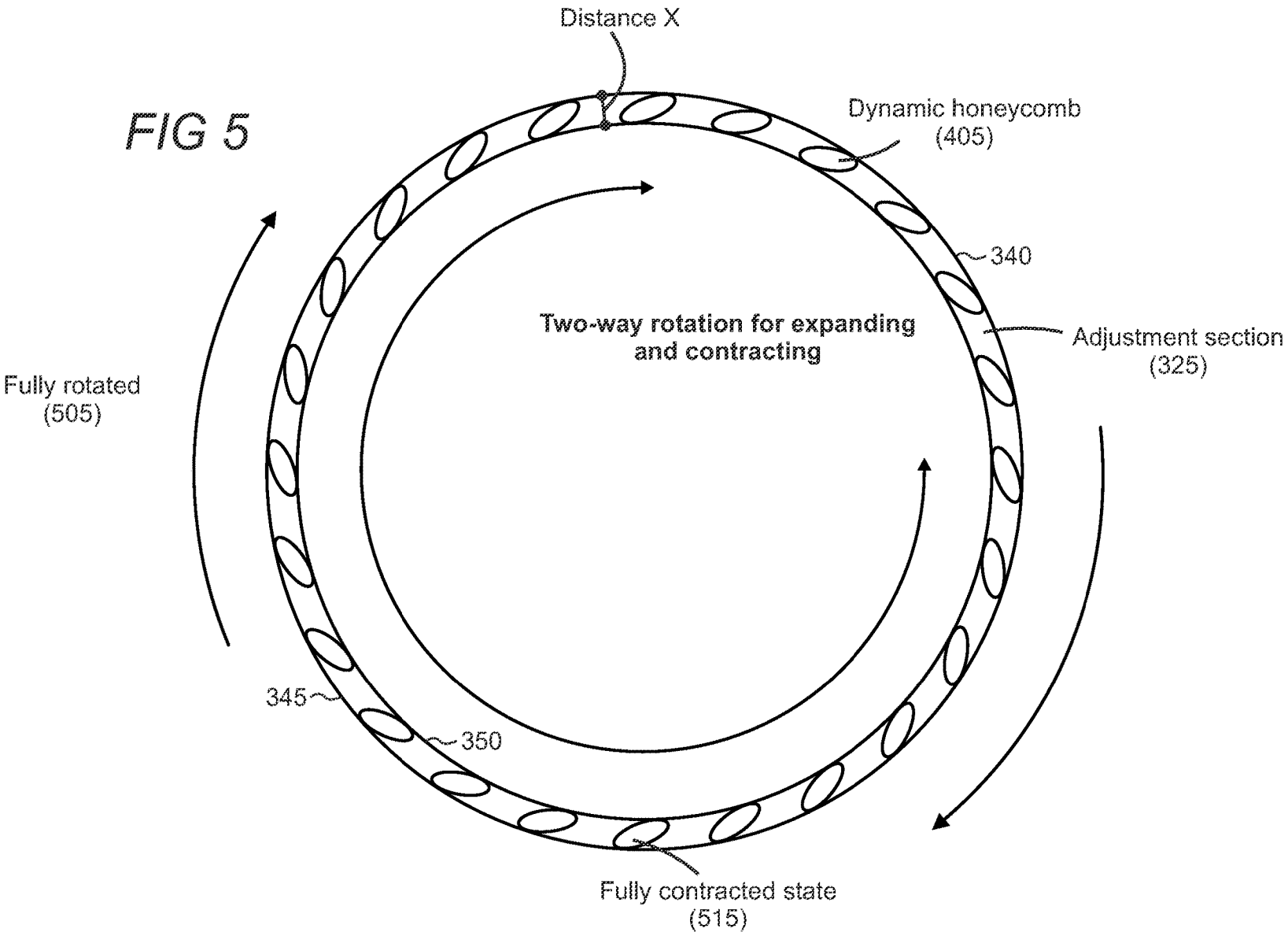
FIGS. 5-8 shows illustrative representations of the earbud's adjustment section from a fully contracted state to a fully expanded state.

FIG. 5 shows an illustrative representation in which the adjustment section 325 is fully contracted, and the rotatable knob 340 is fully rotated clockwise 505. The honeycombs 405 are in a fully contracted state 515; that is, the honeycombs are deformed, which likewise causes the external wall 345 to contract. As shown, there is a Distance X between the external and inside walls when the knob is fully contracted.

Figure 6:
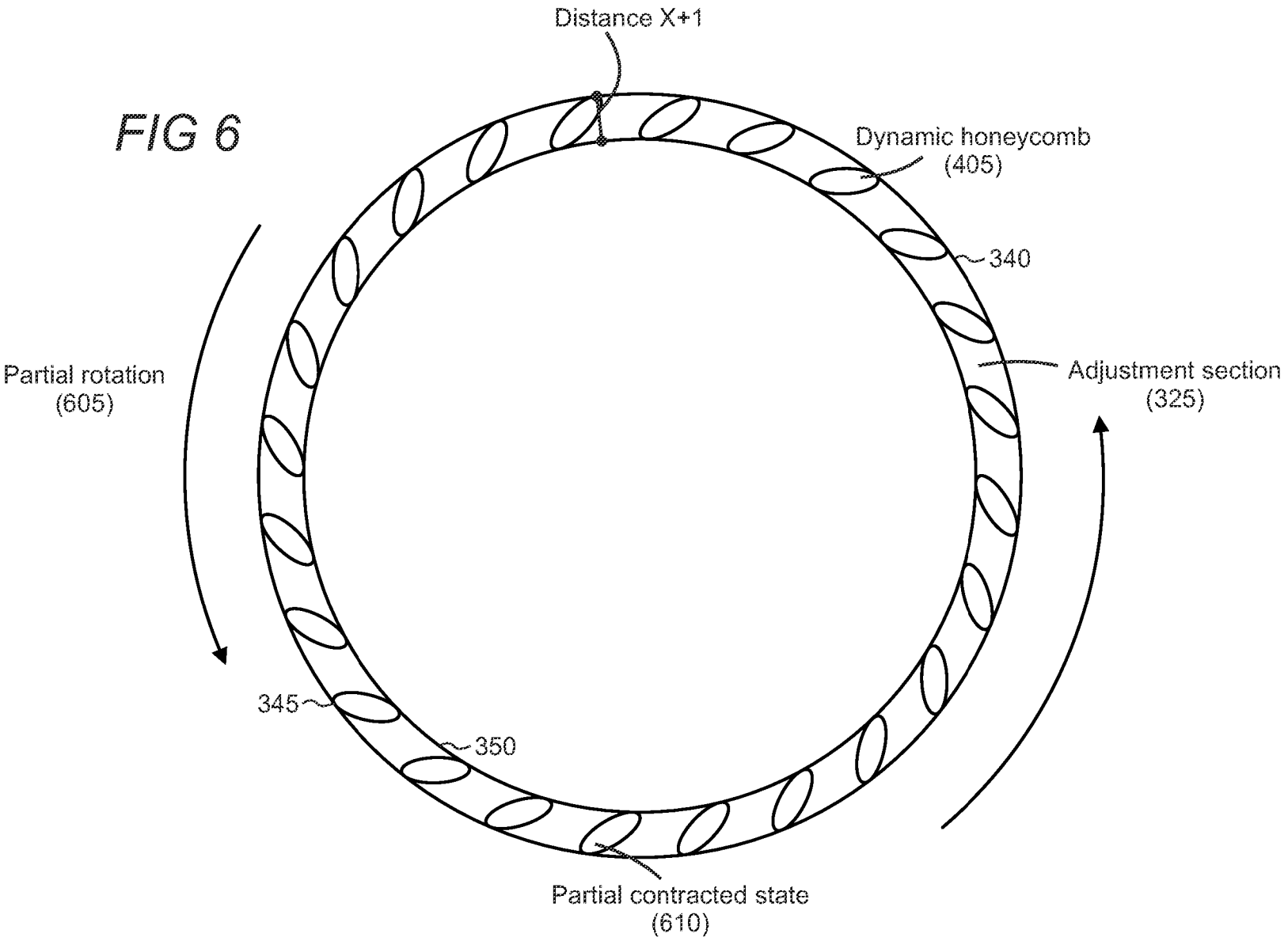

FIG. 6 shows an illustrative representation in which the rotatable knob 340 is partially rotated counterclockwise, as representatively shown by numeral 605, to slightly expand the external wall 345 and the adjustment section 325. The distance between the external and inside walls 345, 350 changes to X+1 when the knob is turned counterclockwise. The X+1 size is exemplary to show the greater circumference of the knob and may represent growth in centimeters, millimeters, etc. The dynamic honeycombs are slightly removed from their fully contracted state (FIG. 5) and enter a partial contracted state 610. This likewise causes the outside wall to expand.

Figure 7:
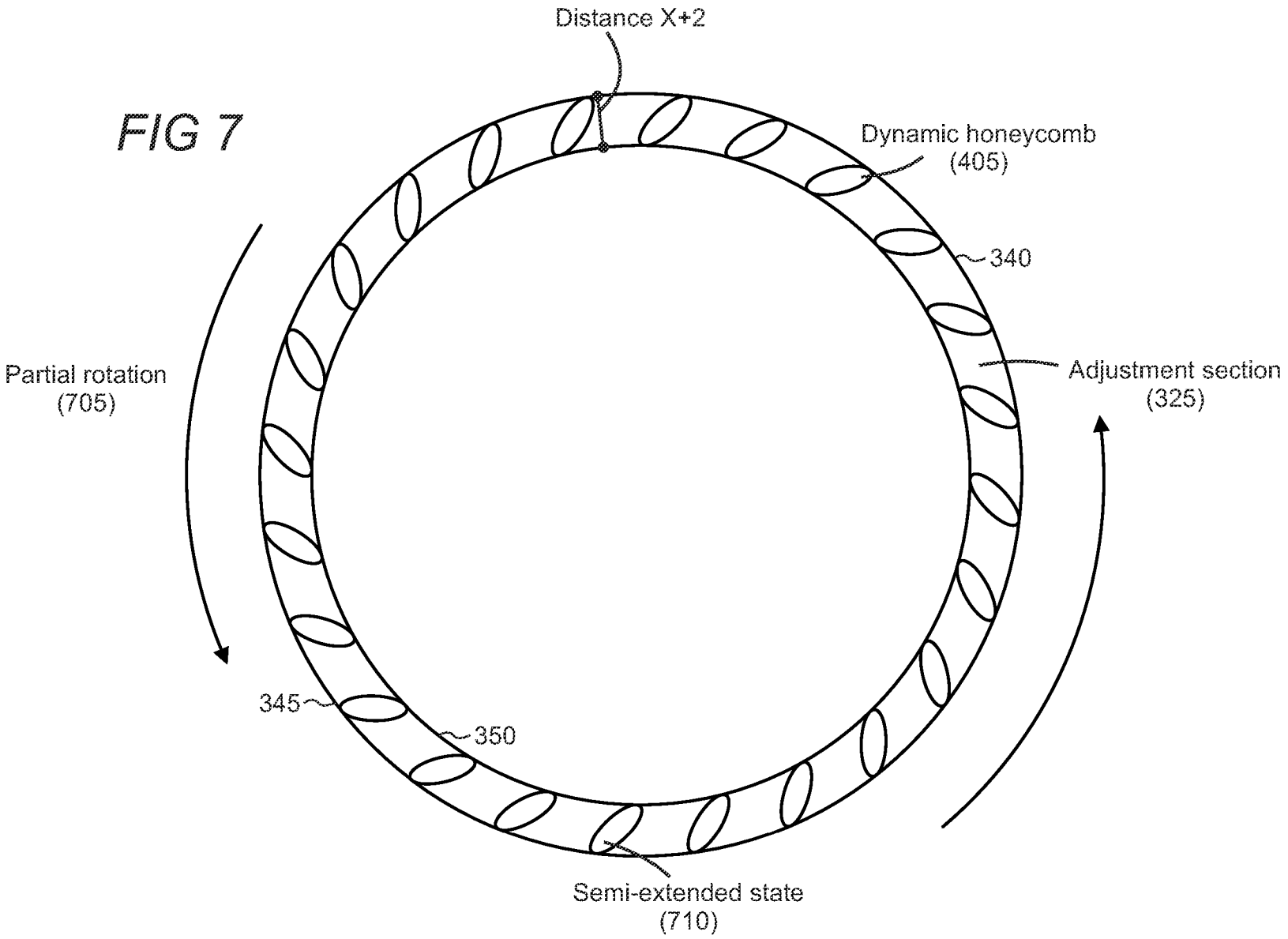

FIG. 7 shows an illustrative representation in which the rotatable knob 340 is partially rotated counterclockwise, as representatively shown by numeral 705, to slightly expand the external wall 345 and the adjustment section 325. The distance between the external and inside walls 345, 350 changes to X+2 when the knob is turned counterclockwise. The X+2 size is exemplary to show the greater circumference of the knob and may represent growth in centimeters, millimeters, etc. The dynamic honeycombs enter a semi-expanded state 710 from the partial contracted state 610 (FIG. 6). This likewise causes the outside wall to expand.

Figure 8:
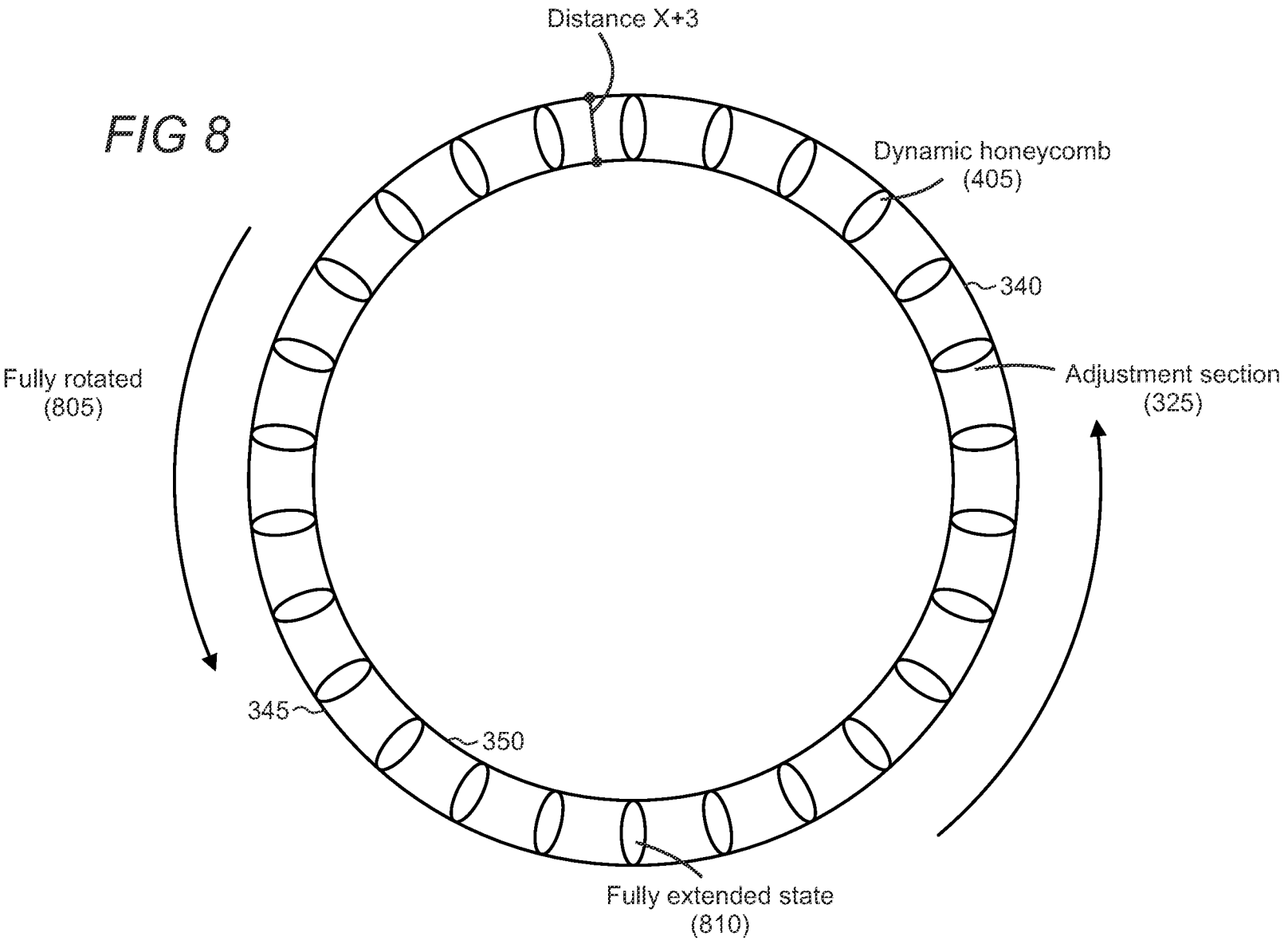

FIG. 8 shows an illustrative representation in which the rotatable knob 340 is partially rotated counterclockwise, as representatively shown by numeral 805, to slightly expand the external wall 345 and the adjustment section 325. The distance between the external and inside walls 345, 350 changes to X+3 when the knob is turned counterclockwise.

The X+3 size is exemplary to show the greater circumference of the knob and may represent growth in centimeters, millimeters, etc. The dynamic honeycombs enter a fully extended state 810 from the semi-expanded state 710 (FIG. 7). This likewise causes the outside wall to expand.

Figure 9:
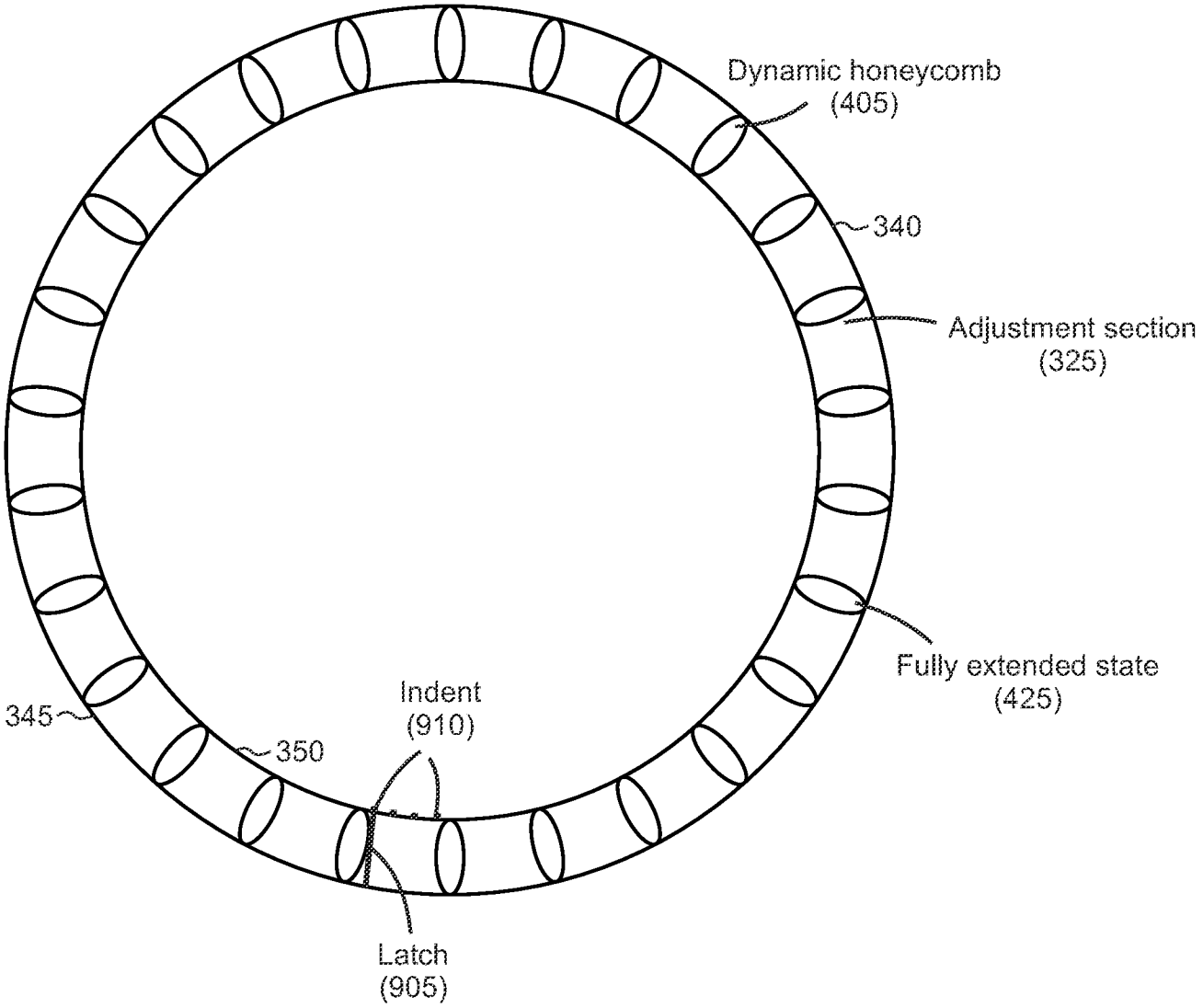
FIG. 9 shows an illustrative representation of a latch implementation to maintain the rotatable knob's position when turned.

FIG. 9 shows an illustrative representation in which a latch 905 extends from an interior of the external wall 345 to the inside wall 350. As the rotatable knob 340 and external wall rotates in a given direction, the latch catches onto an indent 910 on the inside wall, thereby providing a preset number of positions for the adjustment section 325. The latch and recess also prevent the rotatable knob from inadvertently turning and changing size. Each time the user turns the knob, the friction fit between the latch and recess will disengage, and the latch will lock into place with another recess.

Figure 11:
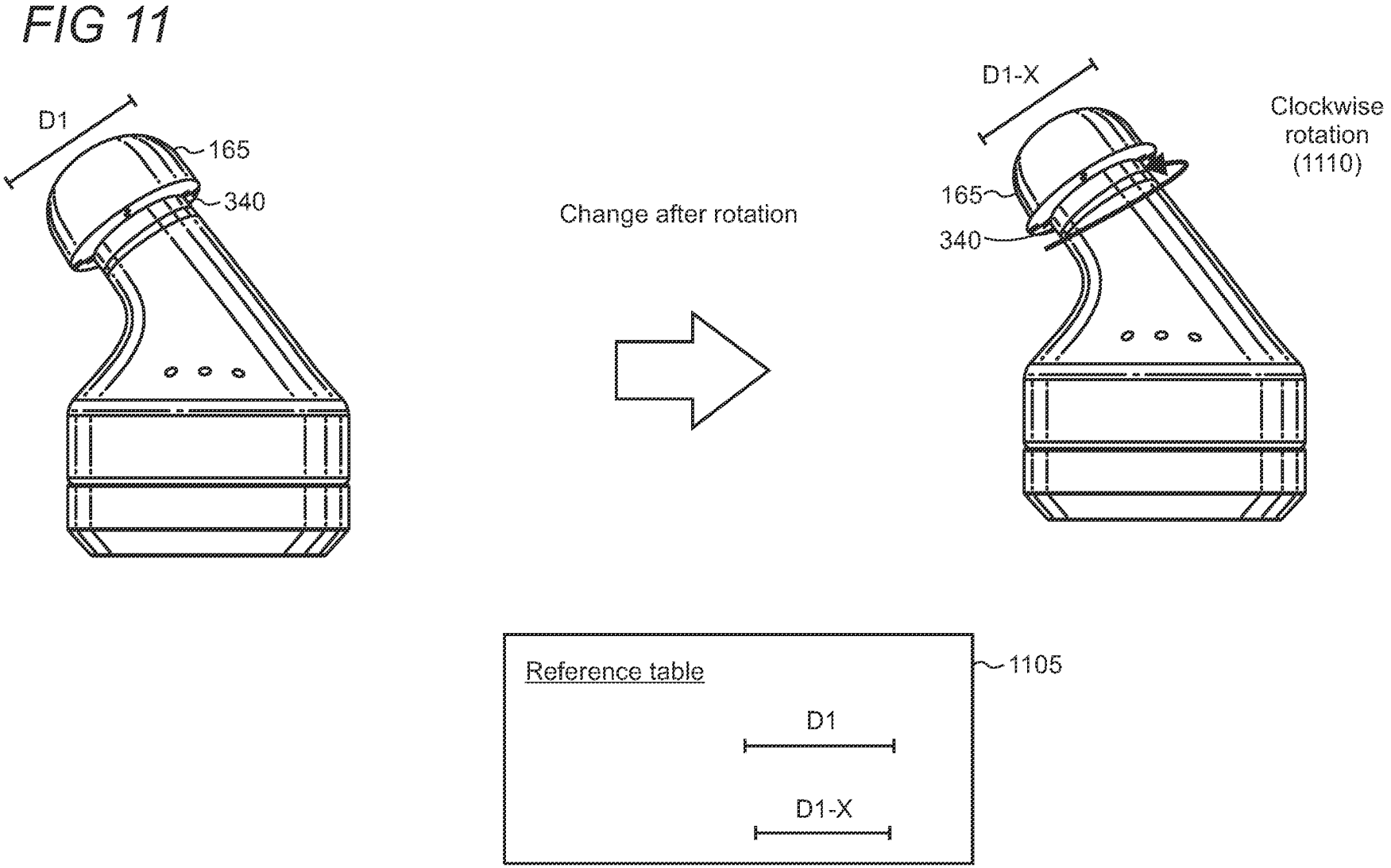
FIG. 11 shows an illustrative representation of a shrunken earbud tip after a clockwise rotation of the rotatable knob.

FIGS. 10 and 11 show illustrative representations of the ear tip's size and shape responsive to rotation of the knob 340. In FIG. 10, after the user performs a counterclockwise rotation 1010 of the knob 340, the ear tip 165 expands. The rotatable knob expands, which causes the snug and malleable ear tip to expand as well. Proportions for FIGS. 10 and 11 are not drawn to scale and are for exemplary purposes only. A measured distance of the size of the ear tip is shown in reference table 1005, which corresponds to the measurement lines above the respective ear tips. As shown, the distance D1 is smaller than the distance D1+X after the knob's rotation and expansion.

In FIG. 11, after the user performs a clockwise rotation 1110 of the knob 340, the ear tip 165 contracts. The rotatable knob contracts, which causes the snug and malleable ear tip to correspondingly contract as well. A measured distance of the size of the ear tip is shown in reference table 1105, which corresponds to the measurement lines above the respective ear tips. As shown, the distance D1 is larger than the distance D1-X after the knob's rotation and contraction.

Various embodiments are disclosed herein. In one embodiment, disclosed is a dynamically resizable earbud, comprising: a main body, in which the main body includes an attachment component; a rotatable knob that attaches to the main body's attachment component, the rotatable knob including a fixed inside wall and a rotatable external wall that rotates about the inside wall, wherein clockwise or counterclockwise rotation of the external wall results in expansion or contraction of the external wall; and an ear tip that removably attaches to an end of the rotatable knob opposite an end that attaches to the main body, in which the ear tip conformably adjusts to changes in size of the rotatable knob's external wall.

As a further example, the external wall latches into two or more positions upon rotating. In another example, the external wall is comprised of a malleable material. As a further example, the external wall is comprised of rubber. In another example, further comprising a series of support structures positioned between and engaging with each of the external and inside walls. As a further example, the support structures deform when rotated in one direction and expand when rotated in an opposite direction. As another example, the support structures are evenly spaced from each other. In another example, the support structures form a polygonal shape. As another example, the inside wall is comprised of a rigid material. In another example, the rigid material includes a plastic or metal.

In another exemplary embodiment, disclosed is a dynamically resizable earbud, comprising: a main body, in which the main body includes an attachment component; a rotatable knob that attaches to the main body's attachment component, the rotatable knob including a fixed and rigid inside wall and a rotatable and malleable external wall that rotates about the inside wall, wherein clockwise or counterclockwise rotation of the external wall results in expansion or contraction of the external wall; and malleable support structures attached to the inside wall and the external wall, in which the support structures are comprised of a same malleable material as the external wall, and the malleable support structures cause the external wall to contract toward and expand away from the inside wall.

In another example, further comprising an ear tip that removably attaches to an end of the rotatable knob opposite an end that attaches to the main body, in which the ear tip conformably adjusts to changes in size of the rotatable knob's external wall. As another example, the support structures form a polygonal shape. As a further example, the polygonal shape is a hexagon. In another example, the external wall latches into two or more positions upon rotating. As a further example, the support structures deform when rotated in one direction and expand when rotated in an opposite direction.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed:

1. A dynamically resizable earbud, comprising:

a main body, in which the main body includes an attachment component;

a rotatable knob that attaches to the main body's attachment component, the rotatable knob including a fixed inside wall and a rotatable external wall that rotates about the inside wall, the external wall being comprised of a malleable material, wherein clockwise or counterclockwise rotation of the external wall results in expansion or contraction of the external wall;

a series of support structures positioned between and engaging with each of the external and inside walls; and an ear tip that removably attaches to an end of the rotatable knob opposite an end that attaches to the main body, in which the ear tip conformably adjusts to changes in size of the rotatable knob's external wall.

2. The dynamically resizable earbud of claim 1, wherein the external wall latches into two or more positions upon rotating.

3. The dynamically resizable earbud of claim 1, wherein the external wall is comprised of rubber.

4. The dynamically resizable earbud of claim 1, wherein the support structures deform when rotated in one direction and expand when rotated in an opposite direction.

5. The dynamically resizable earbud of claim 4, wherein the support structures are evenly spaced from each other.

6. The dynamically resizable earbud of claim 4, wherein the support structures form a polygonal shape.

7. The dynamically resizable earbud of claim 1, wherein the inside wall is comprised of a rigid material.

8. The dynamically resizable earbud of claim 7, wherein the rigid material includes a plastic or metal.

9. A dynamically resizable earbud, comprising:

a main body, in which the main body includes an attachment component;

a rotatable knob that attaches to the main body's attachment component, the rotatable knob including a fixed and rigid inside wall and a rotatable and malleable external wall that rotates about the inside wall, wherein clockwise or counterclockwise rotation of the external wall results in expansion or contraction of the external wall; and malleable support structures attached to the inside wall and the external wall, in which the support structures are comprised of a same malleable material as the external wall, and the malleable support structures cause the external wall to contract toward and expand away from the inside wall.

10. The dynamically resizable earbud of claim 9, further comprising an ear tip that removably attaches to an end of the rotatable knob opposite an end that attaches to the main body, in which the ear tip conformably adjusts to changes in size of the rotatable knob's external wall.

11. The dynamically resizable earbud of claim 9, wherein the support structures form a polygonal shape.

12. The dynamically resizable earbud of claim 11, wherein the polygonal shape is a hexagon.

13. The dynamically resizable earbud of claim 9, wherein the external wall latches into two or more positions upon rotating.

14. The dynamically resizable earbud of claim 9, wherein the support structures deform when rotated in one direction and expand when rotated in an opposite direction.

* * * * *